US007972454B2

(12) United States Patent
O'Hara et al.

(10) Patent No.: US 7,972,454 B2
(45) Date of Patent: Jul. 5, 2011

(54) GASSER COMPOSITION AND METHOD OF GASSING

(75) Inventors: Helen O'Hara, Deer Park (AU); David Stow, Medowie (AU); David Edwin Yates, East Brunswick (AU)

(73) Assignee: Orica Australia Pty Ltd., Melbourne, Victoria (AU)

( * ) Notice: Subject to any disclaimer, the term of this patent is extended or adjusted under 35 U.S.C. 154(b) by 2345 days.

(21) Appl. No.: 09/938,649

(22) Filed: Aug. 27, 2001

(65) Prior Publication Data

US 2003/0140995 A1 Jul. 31, 2003

Related U.S. Application Data

(62) Division of application No. 09/091,856, filed as application No. PCT/AU96/00839 on Dec. 24, 1996, now abandoned.

(30) Foreign Application Priority Data

Dec. 29, 1995 (AU) ..... PN7372

(51) Int. Cl.
*D03D 23/00* (2006.01)

(52) U.S. Cl. ..... 149/109.6; 149/19.2; 149/46

(58) Field of Classification Search ..... 149/109.6
See application file for complete search history.

(56) References Cited

U.S. PATENT DOCUMENTS

| | | | | |
|---|---|---|---|---|
| 3,447,978 | A | | 6/1969 | Bluhm |
| 3,630,250 | A | | 12/1971 | Hradel |
| 3,692,687 | A | | 9/1972 | Duswalt |
| 4,357,184 | A | * | 11/1982 | Binet et al. ..... 149/2 |
| 4,960,475 | A | * | 10/1990 | Cranney et al. ..... 149/46 |
| 4,997,494 | A | * | 3/1991 | Nguyen et al. ..... 149/46 |
| 5,076,867 | A | * | 12/1991 | McKenzie ..... 149/2 |
| 5,490,887 | A | * | 2/1996 | Cranney et al. ..... 149/46 |
| 5,500,062 | A | * | 3/1996 | Chattopadhyay ..... 149/46 |
| 5,920,031 | A | * | 7/1999 | Jahnke ..... 149/46 |
| 5,972,137 | A | * | 10/1999 | Wypkema et al. ..... 149/46 |
| 6,027,588 | A | * | 2/2000 | Vattipalli et al. ..... 149/109.6 |
| 6,165,297 | A | * | 12/2000 | Smith et al. ..... 149/109.6 |

FOREIGN PATENT DOCUMENTS

| | | |
|---|---|---|
| AU | 29408/71 | 11/1973 |
| AU | 30130/77 | 6/1979 |
| AU | 52112/79 | 5/1980 |
| AU | 91353/82 | 6/1983 |
| AU | 14425/83 | 11/1983 |
| AU | 25359/84 | 9/1984 |
| AU | 25706/88 | 6/1989 |
| AU | 77278/91 | 12/1991 |
| AU | 79022/94 | 6/1995 |
| EP | 0018085 | 10/1980 |
| WO | WO 89/02881 | 4/1989 |

* cited by examiner

*Primary Examiner* — Aileen Felton
(74) *Attorney, Agent, or Firm* — Pillsbury Winthop Shaw Pittman LLP

(57) ABSTRACT

A method of preparing a gassed water-in-oil emulsion explosives composition from a gasser solution of an inorganic nitrate, an ammonium species and an optional accelerator which is added to an emulsion explosive composition, reacts and forms gas bubbles is disclosed. The emulsion explosive composition is composed of a discontinuous aqueous phase, a continuous water immiscible organic phase, and an emulsifier. The reaction between the gasser solution and the emulsion explosive composition is such that the emulsifier does not undergo chemical attack.

19 Claims, No Drawings

GASSER COMPOSITION AND METHOD OF GASSING

CROSS-REFERENCE TO RELATED APPLICATIONS

This application is a divisional of U.S. Ser. No. 09/091,856, filed Sep. 28, 1998 (now abandoned), which is the National Phase of PCT/AU96/00839, filed Dec. 24, 1996. These applications, in their entirety, are incorporated herein by reference.

BACKGROUND OF THE INVENTION

1. Field of the Invention

This invention relates to gassing compositions and a method for the preparation of gassed water-in-oil emulsion explosives compositions.

2. Background Information

Emulsion explosives compositions are well known in the explosives industry. The water-in-oil emulsion explosive compositions now in common use were first disclosed in U.S. Pat. No. 3,447,978 (Bluhm) and comprise as components:

(a) a discontinuous aqueous phase comprising discrete droplets of an aqueous solution of inorganic oxygen-releasing salts:

(b) a continuous water-immiscible organic phase throughout which the droplets are dispersed;

(c) an emulsifier which forms an emulsion of the droplets of oxidiser salt solution throughout the continuous organic phase; and optionally (d) a discontinuous gaseous phase and/or closed cell void material.

Emulsion explosives compositions are often blended with a solid particulate oxidiser salt such as ammonium nitrate (AN) prills or particles, which may be coated with or contain fuel oil (FO) to form a low cost explosive of excellent blasting performance. Such compositions are described in Australian Patent Application no. 29408/70 (Butterworth) and U.S. Pat. Nos. 3,161,551 (Egly et al.), 4,111,727 (Clay), 4,181,546 (Clay) and 4,357,184 (Binet et al.).

In water-in-oil emulsion explosives compositions, emulsifiers are used to decrease interfacial tension between the aqueous and oil phases. Molecules of the emulsifier locate at the interface between the aqueous droplet and continuous hydrocarbon phase. The emulsifier molecules are oriented with the hydrophilic headgroup in the aqueous droplet and the lipophilic tail in the continuous hydrocarbon phase. Emulsifiers stabilise the emulsion, inhibiting coalescence of the aqueous droplets and phase separation. The emulsifier also inhibits crystallisation of the oxidiser salt within the droplets which crystallisation can lead to emulsion breakdown and reduction in detonation sensitivity of the emulsion explosive composition.

A variety of emulsifier types and blends are known in the art. For example Australian Patent no. 40006/85 (Cooper & Baker) discloses water-in-oil emulsion explosive compositions which contain a conductivity modifier which may also act as an emulsifier. Included among such conductivity modifiers are condensation products of poly[alk(en)yl] succinic anhydride (PiBSA) with amines such as ethylene diamine, diethylene triamine and ethanolamine.

Such conductivity modifiers/emulsifiers enable the preparation of particularly stable emulsions which are suitable for blending with solid particulate oxidiser salts such as ammonium nitrate (AN) or ammonium nitrate and fuel oil blends (ANFO). The stability of emulsion explosives compositions prepared using such poly[alk(en)yl]succinic anhydride derivatives as conductivity modifiers/emulsifiers enables the preparation of unsensitised emulsion phase (EP) compositions at a dedicated plant under controlled conditions and transport of that EP to the mine site for sensitisation and use.

In general water-in-oil or melt-in-oil emulsion cannot be detonated unless they are sensitised. Sensitising may be carried out by mixing the emulsion with a high explosive such as trinitrotoluene or nitroglycerine or by incorporating small voids into the emulsion which act as hot spots in the detonation. The latter is the preferred method for sensitising a water-in-oil or melt-in-oil emulsion explosive composition.

The most common methods currently used to incorporate voids and sensitise a water-in-oil emulsion composition or emulsion/AN/ANFO blend include in situ gassing using chemical agents, the incorporation of closed cell void material such as microballoons or a mixture of both.

Suitable chemicals for the in situ generation of gas bubbles suitable for use in water-in-oil emulsion explosives include peroxides such as hydrogen peroxide, nitrite salts such as sodium nitrite, nitrosamines such as N,N'-dinitrosopentamethylenetetramine, alkali metal borohydrides such as sodium borohydride and bases such as carbonates including sodium carbonate.

Perhaps the most widely used chemicals for the in situ generation of gas bubbles are nitrous acid and its salts which react under conditions of acid pH to produce nitrogen gas bubbles. Accelerators such as thiocyanate salts, iodides, sulphamic acid or its salts or thiourea may be used to accelerate the reaction of a nitrite gassing agent. The accelerator may also be consumed in the reaction.

One of the problems with this commonly used gasser system of the prior art is that nitroso species generated during the gassing reaction may react with functional moieties on the headgroup of the emulsifier. Functional moieties on the emulsifier headgroup such as certain primary and secondary amines, amides, carboxylic acids, esters and anhydrides are particularly vulnerable to attack by nitroso species. Reaction by nitroso species with the moieties of the headgroup causes chemical changes in the emulsifier which may have a deleterious effect on the emulsifying capability of the emulsifier. As a result the interfacial tension of the droplets of the discontinuous aqueous phase may decrease, causing crystallisation of the of oxidiser salt within the aqueous phase droplets and degradation of the emulsion, possibly even to the point breakdown of the emulsion into separate aqueous and oil phases.

The problem of emulsifier reaction with gassing agents is referred to in Australian Patent Application no. AU-A-77589/94. AU-A-77589/94 relates to chemical gassing using sodium nitrite and teaches that "The commonly used chemical gassing reaction can thus not be used to gas the known PiBSA-based explosive emulsions." In effect, this may lead to the need for different EP's to be used for gassed and ungassed products comprising emulsion explosives compositions and preclude the use of PiBSA derivative emulsifiers in nitrite gassed emulsion explosives compositions and hence the emulsion stability advantages provided by such emulsifiers.

Another problem associated with gassing agents, including nitrite gassing agents of the prior art is the difficulty of evenly distributing the gassing agent throughout the emulsion. International Patent Application WO-89/02881 attempts to address this problem by mixing into the main body of emulsion, a nitrite gassing agent which is also in the form of an emulsion.

One of the drawbacks of using an emulsion gassing agent is that the emulsion gassing agent dilutes both the aqueous and oil phases of the main body of emulsion, reducing the blasting power of the emulsion explosive formed.

One of the other problems associated with the gassing methods and gasser compositions of the prior art is that they had to be added in extremely high proportions to reduce emulsion density to very low densities such as, below 1 g/cc. The presence of extremely high proportion of gasser compositions often adversely affected emulsion stability due to dilution of the continuous or discontinuous phase of the emulsion. If either or both of these phases are overly diluted, there may not be sufficient emulsifier present to maintain an emulsion structure.

SUMMARY OF THE INVENTION

The present applicants have now found a new gasser solution and method of gassing an emulsion which reduces or eliminates the problem of emulsion breakdown experienced using nitrite as the chemical gassing agent. The invention further provides advantages in the preparation of sensitised emulsion explosives compositions in that it enables one emulsion to be used for the preparation of sensitised emulsion explosives compositions regardless of whether they are sensitised using a nitrite chemical gassing agent or using other sensitising means. The gasser solution and method of gassing are particularly effective in improving the stability of emulsifiers in emulsion explosives compositions which comprise emulsifiers which have headgroups which are vulnerable to attack by nitroso species, such as PiBSA based emulsifiers.

Accordingly the present invention provides a gassed emulsion explosive composition comprising an emulsion, excluding micro-emulsions, in combination with a gasser composition; the emulsion having a discontinuous aqueous phase comprising inorganic oxygen releasing salts, a continuous water imiscible organic phase and an emulsifier having a functional moiety which is vulnerable to chemical attack by nitroso species, and the gasser composition having a solution of an inorganic nitrite, an ammonium species and optionally an accelerator, wherein the reaction between the inorganic nitrite and ammonium species occurs within droplets of the gasser solution such that there is substantially no chemical attack on the emulsifier.

The present invention also provides a method of forming the aforementioned gassed emulsion explosives composition wherein the method of gassing an emulsion comprises the steps of:

(a) forming a gasser solution comprising a solution of an inorganic nitrite, an ammonium species and optionally an accelerator,
(b) adding the gasser solution to an emulsion and mixing such that droplets of gasser composition are distributed throughout the emulsion, and
(c) allowing the gasser solution to react and form gas which is distributed as bubbles throughout the emulsion to form the gassed emulsion explosive composition.

Where used herein the term emulsion may refer to a water-in-oil or melt-in-oil emulsion which is unsensitised or partially sensitised and which is suitable as a component of an emulsion explosive composition.

The emulsion explosives composition which is gassed by the method of the current invention may be unsensitised or be partially sensitised by any means known in the art. For example the emulsion explosive composition may comprise glass or plastic microballoons. As such, the gasser solution and method of the current invention may be the sole source of sensitising gas bubbles for an emulsion explosives composition or may be used in conjunction with other gasser solutions or other gasser compositions and gassing methods. In addition, closed cell void material such as glass or plastic microballoons may be used to further sensitise the emulsion explosives composition prior to or after gassing by the method of the current invention.

Without wishing to be bound by theory, it is believed that the gasser solution forms droplets within the emulsion explosives composition and in the presence of the acidic emulsion explosives composition the inorganic nitrite and ammonium species react within the droplets of the gasser solution to form gas bubbles and provide the gassed emulsion explosives composition.

It is preferred that the ratio of inorganic nitrite to ammonium species is between 10:1 and 1:10. It is particularly preferred that the molar proportion of ammonium species present in the gasser solution is up to 10% greater than the molar proportion of inorganic nitrite so that all of the nitrite is consumed by reaction with the ammonium species within the gasser solution droplet. More preferably the ammonium species and inorganic nitrite are present in equimolar quantities.

The ammonium species of the gasser solution of the current invention may be any suitable ammonium species known to those skilled in the art such as ammonia, primary or secondary amines and the salts thereof. Preferred ammonium species include ammonium salts such as ammonium chloride, ammonium nitrate, ammonium chlorate, ammonium perchlorate, ammonium thiocyanate and combinations thereof. The ammonium species may be formed in situ in the droplet of gasser solution, for example by the reaction of ammonia or a primary or secondary amine with a mineral acid or organic acid. The ammonium species may typically comprise up to 25 wt % of the gasser solution.

The inorganic nitrite of the gasser solution of the current invention may be any suitable nitrite salt known to those skilled in the art such as an alkaline earth nitrite, alkali metal nitrite or combinations thereof. In a particularly preferred embodiment the inorganic nitrite is sodium nitrite. Preferably the inorganic nitrite comprises up to 25 wt % of the gasser solution.

The accelerator may be any suitable accelerator known to those skilled in the art such as thiourea, urea, thiocyanate, iodide, cyanate, acetate or the like and combinations thereof. The proportion of accelerator in the gasser composition may be influenced by the solubility of the accelerator but may commonly comprise up to 25 wt % of the gasser composition. In a particularly preferred embodiment the gasser composition comprises up to 3 wt % of thiourea or thiocyanate as accelerator.

The reaction between the nitrite species and ammonium species is pH dependent, being faster in acid conditions than in basic conditions. If the pH is too low, the gasser solution tends to self-gas so quickly that the gassing reaction and gas production may be close to complete before the composition can be mixed into the emulsion. Conversely if the pH is too high, the gassing reaction may proceed too slowly. The pH of the gasser solution is preferably between pH 5 and 9, more preferably between pH 6 and 8 and most preferably relatively close to neutral.

The emulsion may also be buffered, preferably to a pH between pH 5 and 9.

The gasser solution may comprise any suitable solvent but water is the preferred solvent. Other optional additives may also be present.

As indicated above, the inorganic nitrite and ammonium species should be mixed together in solution to form the gasser solution of the present invention. Separate addition of the inorganic nitrite and the ammonium species directly to the emulsion explosives composition does not provide the advantages of the invention which lie in efficient gassing rates and the reduction of elimination of the problem of emulsion breakdown experienced using nitrite as the chemical gassing agent.

The gassing method and gasser solution of the current invention provide a means for reducing emulsion density well below 1.0 g/cc. It should be noted that reduction of emulsion density below 1.0 g/cc was not readily achievable using the gassing methods and gasser solutions and gasser compositions of the prior art. The high proportion of prior art gasser solutions and gasser composition which needed to be added to the emulsion to obtain low density tended to promote emulsion breakdown and phase separation. Using the gassing method and gasser solution of the current invention relatively high proportions of gasser solution can be added to the emulsion, sufficient to reduce the emulsion density well below 1.0 g/cc without significant adverse effects on emulsion stability.

It should be noted that once the gasser solution is formed by mixing together an inorganic nitrite, ammonium species and accelerator, slow reaction and concomitant gas production may occur. This is of no consequence in situations where the gasser solution is made up and quickly thereafter mixed with an emulsion to form an emulsion explosive composition. However if the gasser solution is stored for a relatively long period such as a matter of hours or days, much of the gas product may be lost before the gasser solution can be mixed into the emulsion. In order to overcome this storage problem the inorganic nitrite, ammonium species and accelerator may be stored separately in solid or solution form and mixed to form the gasser solution immediately prior to addition to the emulsion. An accelerator may be stored separately or with either the inorganic nitrite and/or the ammonium species.

Therefore the present invention also envisages and includes mixing of the inorganic nitrite and the ammonium species to form the gasser solution of the present invention immediately before addition to the emulsion or during actual addition to the emulsion.

Suitable oxygen releasing salts for use in the emulsion of the present invention include the alkali and alkaline earth metal nitrates, chlorates and perchlorates, ammonium nitrate, ammonium chlorate, ammonium perchlorate, and mixtures thereof. The preferred oxygen releasing salts include ammonium nitrate, sodium nitrate and calcium nitrate. More preferably the oxygen releasing salt comprises ammonium nitrate or a mixture of ammonium nitrate and sodium or calcium nitrates.

Typically, the oxygen releasing salt component of the compositions of the present invention comprise from 45 to 95 wt % and preferably from 60 to 90 wt % of the total emulsion composition. In compositions wherein the oxygen releasing salt comprises a mixture of ammonium nitrate and sodium nitrate the preferred composition range for such a blend is from 5 to 80 parts of sodium nitrate for every 100 parts of ammonium nitrate. Therefore, in the preferred composition the oxygen releasing salt component comprises from 45 to 90 wt % (of the total emulsion composition), ammonium nitrate or mixtures of from 0 to 40 wt %, sodium or calcium nitrates and from 50 to 90 wt % ammonium nitrate.

Typically the amount of water employed in the emulsion compositions of the present invention is in the range of from 0 to 30 wt % of the total emulsion composition. Preferably the amount employed is from 4 to 25 wt % and more preferably from 6 to 20 wt %.

The water immiscible organic phase of the emulsion composition of the present invention comprises the continuous "oil" phase of the emulsion composition and is the fuel. Suitable organic fuels include aliphatic, alicyclic and aromatic compounds and mixtures thereof which are in the liquid state at the formulation temperature. Suitable organic fuels may be chosen from fuel oil, diesel oil, distillate, furnace oil, kerosene, naphtha, waxes such as microcrystalline wax, paraffin wax and slack wax, paraffin oils benzene, toluene, xylenes, asphaltic materials, polymeric oils such as the low molecular weight polymers of olefines, animal oils, fish oils and other mineral, hydrocarbon or fatty oils, and mixtures thereof. Preferred organic fuels are liquid hydrocarbons generally referred to as petroleum distillates such as gasoline, kerosene, fuel oils and paraffin oils.

Typically the organic fuel or continuous phase of the emulsion explosive composition comprises from 2 to 15 wt % and preferably 3 to 10 wt % of the total composition. As indicated, the gasser solution of the present invention provides advantages relating to stability of the emulsifier and avoiding the problems of the prior art relating to emulsion breakdown which can be experienced where emulsifiers are vulnerable to attack by nitroso species formed when nitrite gassing agents are used to gas emulsion explosives compositions. The gasser solution of the current invention is suitable for use with a variety of emulsifiers having headgroups comprising functional moieties such as primary and secondary amines, amides, carboxylic acids, esters and anhydrides and other groups which may be vulnerable to attack by nitroso species. These may include for example, poly(oxyalkylene) fatty acid esters, amine alkoxylates, fatty acid esters of sorbitol and glycerol, fatty-acid salts, sorbitan esters, poly(oxyalkylene) sorbitan esters, fatty amine alkoxylates, poly(oxyalkylene) glycol esters, fatty acid amines, fatty acid amide alkoxylates, fatty amines, quaternary amines, alkyloxazolines, alkenyloxazolines, imidazolines, alkylsulphonates, alkylarylsulphonates, alkylsulphosuccinates, alkylarylsulphonates, alkylsulphosuccinates, alkylphosphates, alkenylphosphates, phosphate esters, and poly (12-hydroxystearic) acid, and mixtures thereof.

Amongst the preferred emulsifiers are the generic family of poly[alk(en)yl] succinic anhydride based emulsifiers, and particularly polyisobutylene succinic anhydride (PiBSA) based emulsifiers, produced by reaction with amines such as alkanolamines and the like. Where used, particularly preferred additional emulsifiers include sorbitan esters such as sorbitan mono-oleate.

Typically the emulsifier of the water-in-oil of the emulsion comprises up to 5 wt % of the emulsion. Higher proportions of the emulsifying agent may be used and may serve as supplemental fuel for the composition but in general it is not necessary to add more than 5 wt % of emulsifying agent to achieve the desired effect. Stable emulsions can be formed using relatively low levels of emulsifier and for reasons of economy it is preferable to keep the amount of emulsifying agent used to the minimum required to form the emulsion. The preferred level of emulsifying agent used is in the range of from 0.1 to 2.0 wt % of the emulsion.

If desired, other optional fuel materials, hereinafter referred to as secondary fuels, may be incorporated in to the emulsion composition in addition to the water immiscible organic fuel phase. Examples of such secondary fuels include finely divided solids and water miscible organic liquids which can be used to partially replace water as a solvent for the oxygen releasing salts or to extend the aqueous solvent for the oxygen releasing salts. Examples of solid secondary fuels include finely divided materials such as sulphur, aluminium and carbonaceous materials such as gilsonite, comminuted coke or charcoal, carbon black, resin acids such as abietic acid, sugars such as glucose or dextrose and vegetable products such as starch, nut meal, grain meal and wood pulp. Examples of water miscible organic liquids include alcohols such as methanol, glycols such as ethylene glycol, amides such as formamide and urea and amines such as methylamine.

Typically the optional secondary fuel component of the composition of the present invention comprises from 0 to 30 wt % of the total composition.

It lies within the invention that there may also be incorporated into the emulsion composition other substances or mixtures of substances which are oxygen releasing salts or which are themselves suitable as explosive materials. For example the emulsion may be mixed with prilled or particulate ammonium nitrate before or after the emulsion has been gassed.

Other optional additives may also be added to the emulsion explosive compositions hereinbefore described including thickening agents and thickener crosslinking agents such as zinc chromate or a dichromate either as a separate entity or as a component of a conventional redox system such as for example, a mixture of potassium dichromate and potassium antimony tartrate.

The emulsion composition may be prepared by a number of methods. One preferred method of manufacture includes: dissolving said oxygen releasing salts in water at a temperature above the fudge point of the salt solution, preferably at a temperature in the range from 20 to 110° C. to give an aqueous salt solution, combining an aqueous salt solution, a water immiscible organic phase, and an emulsifier with rapid mixing to form a water-in-oil emulsion; and mixing until the emulsion is uniform.

The invention is now demonstrated by but in no way limited to the following Examples. In Examples 1 to 24 various gasser compositions were mixed into a standard emulsion and the performance of the gasser composition was monitored.

The components of the gasser compositions used are recorded in Table 1.

EXAMPLE 1

Preparation of a PiBSA Based Water-in-Oil Emulsion

A water-in-oil emulsion of the following composition was prepared;

| | |
|---|---|
| Oxidiser solution | 91 wt % comprising<br>ammonium nitrate (78.9 wt %)<br>water (20.7 wt %)<br>buffer (0.4 wt %) |
| Fuel phase | 9 wt % comprising a hydrocarbon oil/emulsifier mix. |

The emulsifier was a condensation product of an ethanolamine and poly(isobutylene) succinic anhydride. The emulsion was prepared by dissolving ammonium nitrate in the water at elevated temperature (98° C.) then adjusting the pH of the oxidiser solution so formed to 4.2. The fuel phase was then prepared by melting the microcrystalline wax and mixing it with the hydrocarbon oil/emulsifier mix. The fuel phase was then added in a slow stream to the oxidiser solution at 98° C. with rapid stirring to form a homogeneous water-in-oil emulsion.

Preparation of the Gasser Composition

A neutral pH gasser composition was prepared by dissolving thiourea, sodium nitrite and ammonium nitrate in water. The gasser composition had the following composition;

| | |
|---|---|
| thiourea | 3.0 wt % |
| sodium nitrite | 6.9 wt % |
| ammonium nitrate | 8.0 wt % |
| water | 82.1 wt % |

The mole ratio of sodium nitrite to ammonium nitrite was 1:1. When the components were added together, small bubbles gradually appeared in the gasser composition, indicating slow self-gassing.

The water-in-oil emulsion was kept at a temperature of 55-60° C. as 0.4 wt % of gasser composition was stirred into the emulsion over a 30-second period. After mixing the gasser composition with the emulsion a short induction time followed before reasonably rapid gassing of the emulsion was observed. After 20 minutes, a sample of the emulsion was viewed by microscope. No evidence of emulsion breakdown was observed. Microscopic examination of samples of the gassed emulsion held in storage at ambient temperature for a further 3 weeks showed no evidence of emulsion breakdown or crystallisation.

The final density of the gassed water-in-oil emulsion was 1.09 g/cc as compared with 1.4 g/cc for the ungassed water-in-oil emulsion.

EXAMPLE 2

The water-in-oil emulsion of Example 1 was mixed with a gasser composition which was the same as the gasser composition of Example 1 except that the ammonium nitrate was replaced with ammonium sulphate. The gasser composition had the following composition:

| | |
|---|---|
| thiourea | 3.0 wt % |
| sodium nitrite | 6.9 wt % |
| ammonium sulphate | 9.8 wt % |
| water | 80.3 wt % |

The mole ratio of sodium nitrite to ammonium sulphate was maintained at 1:1. The gassed water-in-oil emulsion explosives formulation produced was almost indistinguishable from that of Example 1 and after 3 days there was no evidence of emulsion breakdown or crystallisation.

EXAMPLE 3

The water-in-oil emulsion of Example 1 was mixed with a gasser composition which was the same as the gasser composition of Example 1 except that the ammonium nitrate was replaced with ammonium perchlorate. The gasser composition had the following composition;

| | |
|---|---|
| thiourea | 3.0 wt % |
| sodium nitrite | 6.9 wt % |
| ammonium perchlorate | 11.4 wt % |
| water | 78.7 wt % |

The mole ratio of sodium nitrite to ammonium perchlorate was maintained at 1:1. The gassed water-in-oil emulsion explosives formulation produced was almost indistinguishable from that of Example 1 and after 3 days there was no evidence of emulsion breakdown or crystallisation.

EXAMPLE 4

The water-in-oil emulsion of Example 1 was mixed with a gasser composition which was the same as the gasser composition of Example 1 except that the ammonium nitrate was replaced with an equimolar mixture of ammonium nitrate and ammonium perchlorate. The gasser composition had the following composition;

| | |
|---|---|
| thiourea | 3.0 wt % |
| sodium nitrite | 6.9 wt % |
| ammonium nitrate/ ammonium perchlorate | 9.8 wt % |
| water | 80.3 wt % |

The mole ratio of sodium nitrite to ammonium cations was maintained at 1:1. The gassed water-in-oil emulsion explosives formulation produced was almost indistinguishable from that of Example 1 and after 3 days there was no evidence of emulsion breakdown or crystallisation.

Examples 1 to 4 illustrate that changing the ammonium species of the gasser composition between ammonium nitrate, ammonium sulphate and ammonium perchlorate does not affect the efficacy of the gasser composition.

EXAMPLE 5

The water-in-oil emulsion of Example 1 was mixed with a gasser composition which was the same as the gasser composition of Example 1 except that no accelerator was used. The mole ratio of sodium nitrite to ammonium nitrate was maintained at 1:1.

There was little evidence of self gassing of the gasser composition prior to its addition to the water-in-oil emulsion composition and when the gasser composition was mixed with the water-in-oil emulsion the rate of gas formation was less than half that of the rate observed for Example 1. The gassed water-in-oil emulsion explosives formulation produced was almost indistinguishable from that of Example 1 and after 3 days there was no evidence of emulsion breakdown or crystallisation.

EXAMPLE 6

The water-in-oil emulsion of Example 1 was mixed with a gasser composition which was the same as the gasser composition of Example 2 except that no accelerator was used. The mole ratio of sodium nitrite to ammonium sulphate was maintained at 1:1. There was no evidence of self gassing of the gasser composition prior to its addition to the water-in-oil emulsion composition and when the gasser composition was mixed with the water-in-oil emulsion the rate of gas formation was less than half that of the rate observed for Example 2.

The gassed water-in-oil emulsion explosives formulation produced was almost indistinguishable from that of Example 1 or 2 and after 3 days there was no evidence of emulsion breakdown or crystallisation.

EXAMPLE 7

The water-in-oil emulsion of Example 1 was mixed with a gasser composition which was the same as the gasser composition of Example 1 except that an acetic acid/acetate buffer had been used to achieve a gasser composition pH of 5.5. The mole ratio of sodium nitrite to ammonium nitrate was maintained at 1:1. Immediately the gasser composition components were mixed there was a great deal of gas bubble formation within the gasser composition. Most of the gassing reaction had finished before the gasser composition could be mixed with water-in-oil emulsion.

The water-in-oil emulsion explosives formulation produced gassed unevenly and the extent of gassing was not as great as that exhibited in Example 1. The density of the gassed emulsion was 1.3 g/cc as compared with 1.4 g/cc for the ungassed emulsion.

EXAMPLE 8

The water-in-oil emulsion of Example 1 was mixed with a gasser composition which was the same as the gasser composition of Example 1 except that an acetic acid/acetate buffer was used to achieve a gasser composition pH of 6.5. The mole ratio of sodium nitrite to ammonium nitrate was maintained at 1:1. Within 1 minute of mixing together the components of the gasser composition vigorous bubble evolution commenced. The gasser composition was then mixed with the water-in-oil emulsion.

The gassed water-in-oil emulsion explosives formulation produced was almost indistinguishable from that of Example 1 and after 3 days there was no evidence of emulsion breakdown or crystallisation.

EXAMPLE 9

The water-in-oil emulsion of Example 1 was mixed with a gasser composition which was the same as the gasser composition of Example 1 except that sodium hydroxide was added to achieve a gasser composition pH of 7.1. The mole ratio of sodium nitrite to ammonium nitrate was maintained at 1:1. Very slow bubble formation was observed for up to 5 minutes after mixing the gasser composition components. The gasser composition was then mixed with the water-in-oil emulsion.

The gassed water-in-oil emulsion explosives formulation produced was almost indistinguishable from that of Example 1 and after 3 days there was no evidence of emulsion breakdown or crystallisation.

EXAMPLE 10

The water-in-oil emulsion of Example 1 was mixed with a gasser composition which was the same as the gasser composition of Example 1 except that sodium carbonate was used to achieve a gasser composition pH of 7.8. The mole ratio of sodium nitrite to ammonium nitrate was maintained at 1:1. After mixing together the gasser composition components, no gas bubble formation was observed for 12 minutes. In the following 2 hours only small bubbles were observed. A sample of freshly mixed gasser composition mixed with the water-in-oil emulsion gave a product which was almost indistinguishable from that of example 1 and after 3 days there was no evidence of emulsion breakdown or crystallisation.

EXAMPLE 11

The water-in-oil emulsion of Example 1 was mixed with a gasser composition which was the same as the gasser composition of Example 1 except that an acetic acid/acetate buffer had been used to achieve a gasser composition pH of 8.2. The mole ratio of sodium nitrite to ammonium nitrate was maintained at 1:1. A small amount of self-gassing of the gasser composition was observed for 24 hours after the gasser composition components were mixed together.

A gassed water-in-oil emulsion produced using a freshly mixed sample of the gasser composition took several days to gas fully however the emulsion produced was extremely storage stable and 3 weeks after gassing had been completed there was no evidence of emulsion breakdown or crystallisation.

Example 1 and Examples 7 to 11 show the effect on the gasser composition of maintaining the same composition but changing the pH. The reaction between the nitrite species and ammonium species is known to be pH dependent, being faster in acid conditions than in basic conditions. If the pH is too low, the gasser composition self-gasses so quickly that the reaction may be close to complete before the composition can be mixed into the water-in-oil emulsion. Conversely if the pH is too high, the gassing reaction may proceed too slowly. The optimal range for pH of the gasser composition lies between about pH 6 and pH 8.

EXAMPLE 12

The water-in-oil emulsion of Example 1 was mixed with a gasser composition which was the same as the gasser composition of Example 1 except that solvent was 50:50 ethanol: water instead of just water. The mole ratio of sodium nitrite to ammonium sulphate was maintained at 1:1.

The gassed water-in-oil emulsion explosives formulation produced was almost indistinguishable from that of Example 1 and after 3 days there was no evidence of emulsion breakdown or crystallisation.

EXAMPLE 13

The water-in-oil emulsion of Example 1 was mixed with a gasser composition which was the same as the gasser composition of Example 1 except that solvent was 50:50 methanol:water instead of just water. The mole ratio of sodium nitrite to ammonium sulphate was maintained at 1:1.

The gassed water-in-oil emulsion explosives formulation produced was almost indistinguishable from that of Example 1 and after 3 days there was no evidence of emulsion breakdown or crystallisation.

Examples 1, 12 and 13 illustrate that changing the solvent of the gasser composition from water to ethanol or methanol does little to change the efficacy of the gasser composition.

EXAMPLE 14

The water-in-oil emulsion of Example 1 was mixed with a gasser composition which was the same as the gasser composition of Example 1 except that the sodium nitrite was replaced with potassium nitrite. The gasser composition had the following composition;

| | |
|---|---|
| thiourea | 3.0 wt % |
| potassium nitrite | 8.5 wt % |
| ammonium nitrate | 8.0 wt % |
| water | 80.5 wt % |

The mole ratio of nitrite anion to ammonium cation was maintained at 1:1. The gassed water-in-oil emulsion explosives formulation produced was almost indistinguishable from that of Example 1 and after 3 days there was no evidence of emulsion breakdown or crystallisation.

EXAMPLE 15

The water-in-oil emulsion of Example 1 was mixed with a gasser composition which was the same as the gasser composition of Example 1 except that the sodium nitrite was replaced with magnesium nitrite. The gasser composition had the following composition;

| | |
|---|---|
| thiourea | 3.0 wt % |
| magnesium nitrite | 11.6 wt % |
| ammonium nitrate | 8.0 wt % |
| water | 77.4 wt % |

The mole ratio of nitrite anion to ammonium cation was maintained at 1:1. The gassed water-in-oil emulsion explosives formulation produced was almost indistinguishable from that of Example 1 and after 3 days there was no evidence of emulsion breakdown or crystallisation.

Examples 1, 14 and 15 illustrate that the gasser composition of the present performs equally well irrespective of whether an alkaline earth metal nitrite or alkaline earth nitrate is used.

EXAMPLE 16

The water-in-oil emulsion of Example 1 was mixed with a gasser composition which was the same as the gasser composition of Example 1 except that the thiourea accelerator was replaced by an equimolar quantity of urea.

The gassed water-in-oil emulsion explosives formulation produced was almost indistinguishable from that of Example 1 and after 3 days there was no evidence of emulsion breakdown or crystallisation.

EXAMPLE 17

The water-in-oil emulsion of Example 1 was mixed with a gasser composition which was the same as the gasser composition of Example 1 except that the thiourea accelerator was replaced by an equimolar quantity of ammonium thiocyanate.

The gassed water-in-oil emulsion explosives formulation produced was almost indistinguishable from that of example 1 and after 3 days there was no evidence of emulsion breakdown or crystallisation.

EXAMPLE 18

The water-in-oil emulsion of Example 1 was mixed with a gasser composition which was the same as the gasser composition of Example 1 except that the thiourea accelerator was replaced by an equimolar quantity of sodium iodide.

The gassed water-in-oil emulsion explosives formulation produced was almost indistinguishable from that of Example 1 and after 3 days there was no evidence of emulsion breakdown or crystallisation.

Examples 1, 16, 17 and 18 illustrate that different accelerator species can be used successfully in the gasser composition of the current invention.

EXAMPLE 19

A gasser solution was prepared by the same method as described in example 1 but with a higher concentration of ammonium nitrate and sodium nitrite. The gasser composition had the following compositions;

| | |
|---|---|
| thiourea | 3.0 wt % |
| sodium nitrite | 8.6 wt % |
| ammonium nitrate | 10.0 wt % |
| water | 78.4 wt % |

The mole ratio of sodium nitrite to ammonium nitrite was maintained at 1:1. Small bubbles rapidly formed in the gasser composition, indicating self-gassing. The gasser composition was added to the water-in-oil emulsion in the manner described in Example 1.

After mixing the gasser composition with the emulsion immediate, rapid gassing of the emulsion was observed. After 20 minutes, a sample of the emulsion was viewed by microscope. No evidence of emulsion breakdown was observed. After a further 2 weeks another sample of emulsion was viewed by microscope. No emulsion breakdown or crystallisation was occurred.

The final density of the gassed water-in-oil emulsion was 1.00 g/cc as compared with 1.14 g/cc for the ungassed water-in-oil emulsion.

A comparison of Examples 1 and 19 shows that an increase of concentration of nitrite and ammonium species in the gasser composition increases the rate of gassing and provides a gassed water-in-oil emulsion of lower density.

EXAMPLE 20

A gasser composition was prepared by the same method as described in Example 1 but with a mole ratio of sodium nitrite which was 50% higher than that of ammonium nitrate. The gasser composition had the following composition;

| | |
|---|---|
| thiourea | 3.0 wt % |
| sodium nitrite | 10.35 wt % |
| ammonium nitrate | 8.0 wt % |
| water | 78.65 wt % |

The mole ratio of sodium nitrite to ammonium nitrate was 1.5:1. The gasser composition was added to the water-in-oil emulsion in the manner described in Example 1.

After mixing the gasser composition with the emulsion immediately, rapid gassing of the emulsion was observed. After 20 minutes, a sample of the emulsion was viewed by microscope and no evidence of emulsion breakdown was observed. After a further 2 weeks another sample of emulsion was viewed by microscope. No emulsion breakdown or crystallisation was observed.

A comparison of Example 1 to Example 20 shows that where the mole quantity of nitrite exceeds that of the ammonium species there is no adverse affect on the stability of the emulsion in the first few weeks of storage.

EXAMPLE 21

A gasser composition was prepared by the same method as described in Example 1 but with a mole ratio of sodium nitrite which was 50% lower than that of ammonium nitrate. The gasser composition had the following composition;

| | |
|---|---|
| thiourea | 3.0 wt % |
| sodium nitrite | 6.9 wt % |

-continued

| | |
|---|---|
| ammonium nitrate | 12.0 wt % |
| water | 78.1 wt % |

The mole ratio of sodium nitrite to ammonium nitrite was 1:1.5. The gasser composition was added to the water-in-oil emulsion in the manner described in Example 1.

After mixing the gasser composition with the emulsion immediately the gassing reaction proceeded in the same manner as described in Example 1. The gassed emulsion produced was almost indistinguishable from that of Example 1 and no differences in the gassing rate or extent of gassing was observed. No emulsion breakdown or crystallisation was observed even after 3 weeks of storage.

A comparison of Example 1 to Example 21 shows that increasing the mole quantity of the ammonium species so that it exceeds the mole quantity of the nitrite species has no effect on the gassing reaction.

Comparative Example 1 (CE1)

Preparation of the Comparative Gasser Composition

A gasser composition of the prior art was prepared by dissolving sodium nitrite and sodium thiocyanate in water. The gasser composition had the following composition;

| | |
|---|---|
| sodium nitrite | 23.0 wt % |
| sodium thiocyanate | 23.0 wt % |
| water | 54.0 wt % |

A water-in-oil emulsion prepared according to the method and composition of example 1 was kept at a temperature of 55-60° C. as 0.4 wt % of gasser composition was stirred into the emulsion over a 30-second period.

After mixing the gasser composition with the emulsion a short induction time followed before reasonably rapid gassing of the emulsion was observed. After 20 minutes, a sample of the emulsion was viewed by microscope. No evidence of emulsion breakdown was observed.

The density of the gassed water-in-oil emulsion was 1.00 g/cc as compared with 1.4 g/cc for the ungassed water-in-oil emulsion.

A further sample examined by microscope 24 hours later revealed some crystallisation but no emulsion breakdown. After a further 3 days another sample of emulsion was viewed by microscope. A large amount of emulsion crystallisation and breakdown was observed.

Comparison of CE1 and Examples 1 and 19 shows that the gasser composition of the current invention can be used to achieve emulsion densities equivalent with those obtained using the gasser composition of the prior art, however the gasser compositions of the current invention are less prone to causing crystallisation and emulsion breakdown.

EXAMPLE 22

Two samples of PiBSA based water-in-oil emulsion of Example 1 were mixed with prilled ammonium nitrate in a ratio of 70:30 by weight. The gasser compositions of the current invention were then added to the prill doped emulsion and the gassing rate measured. The gasser composition of the prior art as described in CE1 was added to a separate sample of 70:30 prill doped water-in-oil emulsion of Example 1 and the gassing rate measured to provide a comparison.

The gasser compositions used were of the following composition;

| Component | Example 22(a) | Example 22(b) |
|---|---|---|
| Sodium nitrite | 13.2 wt % | 21.0 wt % |
| Ammonium nitrate | 17.6 wt % | 24.3 wt % |

Both gasser composition comprised 5 wt % thiourea as accelerator and water was the solvent. The results of the gassing measurements are recorded in FIG. 1.

It is clear from FIG. 1 that the gassing rate of the gasser composition of the current invention is equivalent to that of the gasser composition of the prior art.

EXAMPLE 23

The water-in-oil emulsion of Example 1 was mixed with prilled ammonium nitrate in the proportions of 80:20 by weight, emulsion:prill. Differing amounts of a gasser composition of the current invention was added to four samples of the prill doped emulsion and the densities of the gassed emulsions were measured over time. The gasser composition of the prior art as described in CE1 was added to a separate sample of the water-in-oil emulsion of Example 1 and the density of the gassed emulsion was measured over time to provide a comparison. The gasser composition of the current invention was as follows;

| Component | Example 23 |
|---|---|
| Sodium nitrite | 18.0 wt % |
| Ammonium nitrate | 21.0 wt % |
| Thiourea | 3.0 wt % |
| Water | 58.0 wt % |

The proportions of gasser composition added to the water-in-oil emulsion were as follows;

| | |
|---|---|
| Example 23(a) | 0.75 wt % |
| Example 23(b) | 1.5 wt % |
| Example 23(c) | 2.0 wt % |

The gasser composition of CE1 was added at a proportion of 0.5 wt %. Density measurements using higher proportions of the gasser composition of CE1 could not be determined because of emulsion breakdown and phase separation. It was noted that none of the emulsions gassed with the gasser composition of the current invention displayed any signs of emulsion breakdown and after 1 month of storage microscopic examination of samples of the gassed emulsion showed only a very small amount of crystallisation.

The results of the density measurements are recorded in FIG. 2. The results show that the gasser composition of the current invention can reduce emulsion density well below 1.0 g/cc at a rate which is comparable with the gassing rate of the gasser composition of the prior art. The results also show that the density of the gassed emulsion product can be controlled by adding different proportions of the gasser composition of the current invention. While the invention has been explained in relation to its preferred embodiments it is to be understood that various modifications thereof will become apparent to those skilled in the art upon reading the specification. Therefore, it is to be understood that the invention disclosed herein is intended to cover such modifications as fall within the scope of the appended claims.

TABLE 1

| Gasser Composition of Example | Inorganic Nitrite [a] (wt %) | Ammonium Species [b] (wt %) | Mole Ratio a:b | Accelerator (wt %) | Solvent | pH | |
|---|---|---|---|---|---|---|---|
| 1 | SNI (6.9) | AN (8.0) | 1:1 | T (3) | water | 7.0 | |
| 2 | SNI (6.9) | AS (9.8) | 1:1 | T (3) | water | 7.0 | |
| 3 | SNI (6.9) | AP (11.4) | 1:1 | T (3) | water | 7.0 | |
| 4 | SNI (6.9) | AN & AP (9.8) | 1:1 | T (3) | water | 7.0 | Mole ratio AN: AP was 1:1 |
| 5 | SNI (6.9) | AN (8.0) | 1:1 | nil | water | 7.0 | |
| 6 | SNI (6.9) | AS (9.8) | 1:1 | nil | water | 7.0 | |
| 7 | SNI (6.9) | AN (8.0) | 1:1 | T (3) | water | 5.5 | |
| 8 | SNI (6.9) | AN (8.0) | 1:1 | T (3) | water | 6.5 | |
| 9 | SNI (6.9) | AN (8.0) | 1:1 | T (3) | water | 7.1 | |
| 10 | SNI (6.9) | AN (8.0) | 1:1 | T (3) | water | 7.8 | |
| 11 | SNI (6.9) | AN (8.0) | 1:1 | T (3) | water | 8.2 | |
| 12 | SNI (6.9) | AN (8.0) | 1:1 | T (3) | ethanol | 7.0 | |
| 13 | SNI (6.9) | AN (8.0) | 1:1 | T (3) | methanol | 7.0 | |
| 14 | PNI (8.5) | AN (8.0) | 1:1 | T (3) | water | 7.0 | |
| 15 | MNI (11.6) | AN (8.0) | 1:1 | T (3) | water | 7.0 | |
| 16 | SNI (6.9) | AN (8.0) | 1:1 | U (3) | water | 7.0 | |
| 17 | SNI (6.9) | AN (8.0) | 1:1 | AT (3) | water | 7.0 | |
| 18 | SNI (6.9) | AN (8.0) | 1:1 | SI (3) | water | 7.0 | |
| 19 | SNI (6.9) | AN (8.0) | 1:1 | T (3) | water | 7.0 | |
| 20 | SNI (10.35) | AN (8.0) | 1.5:1 | T (3) | water | 7.0 | Same as Example 1 but the level of SNI is increased from 6.9 wt % to 10.35 wt % |
| 21 | SNI (6.9) | AN (8.0) | 1:1.5 | T (3) | water | 7.0 | |
| CE 1 | SNI (6.9) | — | — | ST (23) | water | 7.0 | |
| 22 (a) | SNI (13.2) | AN (17.6) | 1:1 | T (5) | water | 7.0 | |

TABLE 1-continued

| Gasser Composition of Example | Inorganic Nitrite [a] (wt %) | Ammonium Species [b] (wt %) | Mole Ratio a:b | Accelerator (wt %) | Solvent | pH |
|---|---|---|---|---|---|---|
| 22 (b) | SNI (21.0) | AN (24.3) | 1:1 | T (5) | water | 7.0 |
| 23 | SNI (18.0) | AN (21.0) | 1:1 | T (3) | water | 7.0 |

AN = ammonium nitrate
AP = ammonium perchlorate
AS = ammonium sulphate
AT = ammonium thiocyanate
MNI = magnesium nitrite
PNI = potassium nitrite
SA = sodium acetate
SI = sodium iodide
SMO = sorbitan mono-oleate
SNI = sodium nitrite
ST = sodium thiocyanate
T = thiourea
U = urea

The invention claimed is:

1. A method of forming a gassed emulsion explosive composition comprising:

(a) forming a gasser solution comprising a solution of an inorganic nitrite, an ammonium species and optionally an accelerator;

(b) adding the gasser solution to an emulsion explosive composition having a discontinuous aqueous phase comprising inorganic oxygen releasing salts, a continuous water immiscible organic phase and a poly[alk(en)yl] succinic anhydride based emulsifier such that droplets of gasser composition are distributed throughout the emulsion explosive composition; and (c) allowing the inorganic nitrite and the ammonium species of the gasser solution to react and form gas which is distributed as bubbles throughout the emulsion to form the gassed emulsion explosive composition;

wherein the gasser solution is formed during or immediately before addition of the gasser solution to the emulsion explosive composition by mixing the inorganic nitrite, ammonium species and optionally the accelerator, and wherein the reaction between the inorganic nitrite and the ammonium species occurs within droplets of the gasser solution such that there is substantially no chemical attack on the emulsifier.

2. A method according to claim 1, wherein the emulsifier is a polyisobutylene succinic anhydride based emulsifier.

3. A method according to claim 1, wherein the gasser solution has a pH between pH 5 and pH 9.

4. A method according to claim 3, wherein the gasser solution has a pH between pH 6 and pH 8.

5. A method according to claim 1, wherein in forming the gasser solution, the ratio of inorganic nitrite to ammonium species is between 10:1 and 1:10.

6. A method according to claim 1, wherein in forming the gasser solution, the molar proportion of ammonium species is up to 10% greater than the molar proportion of inorganic nitrite.

7. A method according to claim 1, wherein in forming the gasser solution, the ammonium species and inorganic nitrite are present in equimolar quantities.

8. A method according to claim 1, wherein in forming the gasser solution, the ammonium species and inorganic nitrite are present in equimolar quantities and the gasser solution pH is between pH 5 and pH 9.

9. A method according to claim 1, wherein the ammonium species is selected from the group consisting of ammonium chloride, ammonium nitrate, ammonium chlorate, ammonium perchlorate and combinations thereof.

10. A method according to claim 1, wherein the ammonium species is formed in situ in the gasser composition.

11. A method according to claim 1, wherein the ammonium species comprises up to 25 wt. % of the gasser solution.

12. A method according to claim 1, wherein the inorganic nitrite is selected from the group consisting of alkaline earth nitrites, alkali metal nitrites and combinations thereof.

13. A method according to claim 1, wherein the inorganic nitrite comprises up to 25 wt. % of the gasser solution.

14. A method according to claim 1, wherein the gasser solution comprises an accelerator selected from the group consisting of thiourea, thiocyanate, iodide, cyanate, acetate and combinations thereof.

15. A method according to claim 1, wherein the accelerator comprises up to 25 wt. % of the gasser solution.

16. A method according to claim 1, wherein the gassed emulsion explosive composition has a density of less than 1.0 g/cc.

17. A method according to claim 16, wherein the gassed emulsion explosive composition has a density of less than 0.8 g/cc.

18. A method according to claim 1, which additionally comprises adding to the emulsion explosive composition a closed cell void material selected from the group consisting of glass microballoons, plastic microballoons and mixtures thereof.

19. A method according to claim 1, wherein the emulsifier comprises a primary amine, secondary amine, amide, carboxylic acid, ester or anhydride group.

* * * * *